US005098039A

United States Patent [19]

Linden, Jr.

[11] Patent Number: 5,098,039

[45] Date of Patent: Mar. 24, 1992

[54] NIGHT KITE

[76] Inventor: Kenneth M. Linden, Jr., 4177 NW. 5th Ave., Boca Raton, Fla. 33431

[21] Appl. No.: 929,599

[22] Filed: Nov. 12, 1986

[51] Int. Cl.[5] ..... B64C 31/06

[52] U.S. Cl. ..... 244/153 R; 244/155 R; D21/88; 40/212

[58] Field of Search ..... 244/153 R, 155 R, 33; 40/212, 214, 575; 446/225, 226; D21/87-88

[56] References Cited

U.S. PATENT DOCUMENTS

| | | | |
|---|---|---|---|
| 346,924 | 8/1886 | Kuell | 40/214 |
| 1,189,206 | 6/1916 | Moreira | 244/153 R |
| 1,568,011 | 12/1952 | Trippeda et al. | 40/214 |
| 1,821,465 | 9/1931 | Dysert | 244/153 R |
| 1,882,647 | 10/1932 | Kanolt | 40/575 |
| 2,592,444 | 4/1952 | Matelena | 40/214 |
| 2,632,614 | 3/1953 | Bodell | 244/153 R |
| 3,684,219 | 8/1972 | King | 244/155 R |
| 3,771,247 | 11/1973 | DeHarak | 40/212 |
| 4,286,762 | 9/1981 | Prouty | 244/153 R |

*Primary Examiner*—Galen Barefoot

*Attorney, Agent, or Firm*—Malin, Haley, McHale, DiMaggio & Crosby

[57] ABSTRACT

A kite designed for night flying, the kite having a facial ornamental design, comprising a frame means for providing the structural support of the kite, the frame means including a plurality of frame members being in mechanical association with one another. A body means provides the aerodynamic flight characteristics of the kite, the body means being supported by the frame means. The body means inlcudes an interchangeable face means, the interchangeable face means allowing the selective substitution of a variety of ornamental designs for the kite. The kite includes an illumination means for illuminating the ornamental designs of the kite, the illumination means also being supported by the frame means. The illumination means renders the kite readily visible while in night flight, whereby a kite is provided which exhibits striking nocturnal features when viewed by the human eye.

8 Claims, 2 Drawing Sheets

NIGHT KITE

BACKGROUND OF THE INVENTION

The subject matter of the invention relates to kites, and more particularly to kites used for night flying.

A great variety of kites have long been known in the art which are designed for day flying. These kites include a tremendous variety of configurations, shapes, colors and sizes. Kites have also been known to have a variety of distinguishing aerodynamic features which are meant to enhance maneuverability of the kites.

However, night kites have not received much attention in this art. U.S. Pat. No. 1,326,434 issued to E. Bergher discloses a night kite of sorts designed for military applications in identifying the positioning of troops and for the lifting and support of antenna equipment or related devices. U.S. Pat. Nos. 800,926 and 800,927 issued to P. Mahony disclose a life saving apparatus for use on ships and vessels for the lifting and running of life lines or hawsers during times of emergency.

These patents do not deal with the problem of designing a highly efficient, light weight, low power light, allowing one to have interchangeable ornamental faces on kites flown at great heights, or a kite designed to enhance the visual perception of the ornamental designs. Similarly, the art has not dealt with enhancing the illumination means of a kite for effective visual presentation.

It is therefore highly desirable to provide a night kite which allows for the selective substitution of a plurality of ornamental designs within an interchangeable face means.

It is also highly desirable to provide a night kite which utilizes an efficient illumination means for illuminating ornamental designs, such that said ornamental designs are readily visible to the eyes of human observers while said kite is engaged in night flight.

It is also highly desirable to provide a night kite which is cost effective yet operationally efficient.

It is also highly desirable to provide a night kite which utilizes a highly efficient illumination means which is structurally sound yet lightweight, allowing said kite to be viewed in night flight at heights exceeding 200 feet.

It is also highly desirable to provide a night kite which provides striking visual effects and maximizes the presentation of ornamental designs on the face of the kite.

It is finally highly desirable to provide a night kite which incorporates all of the above mentioned features.

SUMMARY OF THE INVENTION

It is therefore an object of the invention to provide a night kite which allows for the selective substitution of a plurality of ornamental designs within an interchangeable face means.

It is therefore an object of the invention to provide a night kite which utilizes an efficient illumination means for illuminating ornamental designs, such that said ornamental designs are readily visible to the eyes of human observers while said kite is engaged in night flight.

It is therefore an object of the invention to provide a night kite which is cost effective yet operationally efficient.

It is therefore an object of the invention to provide a night kite which utilizes a highly efficient illumination means which is structurally sound yet lightweight, allowing said kite to be viewed in night flight at heights exceeding 200 feet.

It is therefore an object of the invention to provide a night kite which provides striking visual effects and maximizes the presentation of ornamental designs on the face of the kite.

It is therefore an object of the invention to provide a night kite which incorporates all of the above mentioned features.

Briefly, what is provided is a night kite designed for night flying, the kite having a facial ornamental design, comprising a frame means for providing the structural support of the kite, the frame means including a plurality of frame members being in mechanical association with one another. A body means provides the aerodynamic flight characteristics of the kite, the body means being supported by the frame means. The body means includes an interchangeable face means, the interchangeable face means allowing the selective substitution of a variety of ornamental designs for the kite. The kite includes an illumination means for illuminating the ornamental designs of the kite, the illumination means also being supported by the frame means. The illumination means renders the kite readily visible while in night flight, whereby a kite is provided which exhibits striking nocturnal features when viewed by the human eye.

BRIEF DESCRIPTION OF THE DRAWINGS

The above mentioned and other features and objects of this invention and the manner of attaining them will become more apparent and the invention itself will become best understood by reference to the following description of an embodiment of the invention taken in conjunction with the accompanying drawings, wherein.

DESCRIPTION OF A SPECIFIC EMBODIMENT

Figure 1:
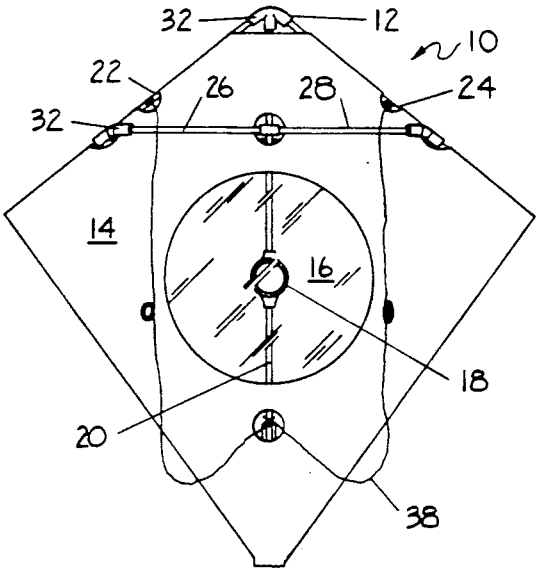
FIG. 1 is a front plan view of an embodiment of the invention.

Referring now to FIG. 1 night kite 10 is generally illustrated. Nite kite 10 is shown as having frame means 12, body means 14, interchangeable face means 16, and illumination means 18.

Frame means 12 is comprised of a plurality of frame members which are in mechanical association with one another.

In a specific embodiment frame means 12 is comprised of longitudinal central member 20, first and second diagonal members 22 and 24, first and second transverse members 26 and 28, and third transverse member 30. These structural members provide the frame for the invention which supports the body means 14 as well as the illumination means 18.

The frame members are each mechanically connected to one another utilizing sleeve inserts 32. As is apparent to one skilled in the art, any conventional method could be utilized to interconnect the plurality of frame members, including without limitation, adhesives, tapes, mechanical fasteners, as well as strings or twines.

Figure 2:
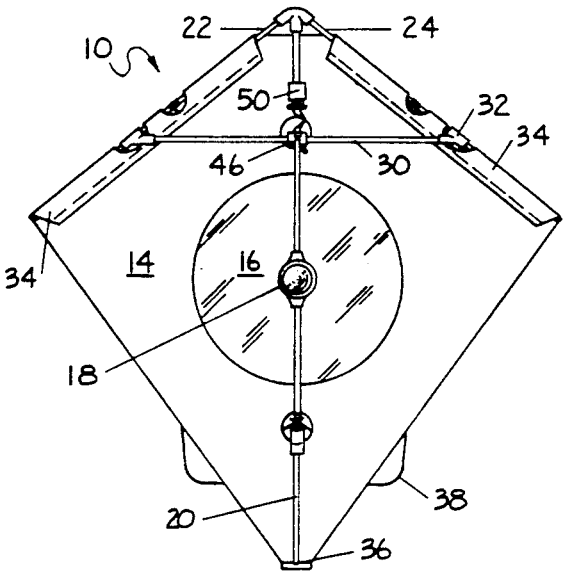
FIG. 2 is a rear plan view of an embodiment of the invention.
Figure 3:
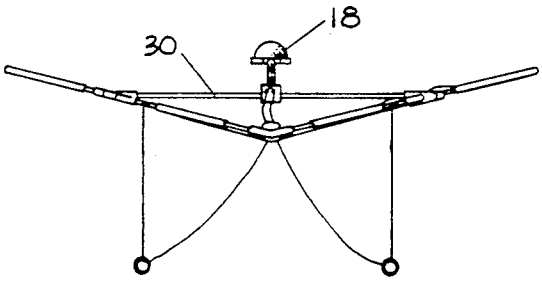
FIG. 3 is a top plan view of the invention as illustrated in FIG. 1.
Figure 4:
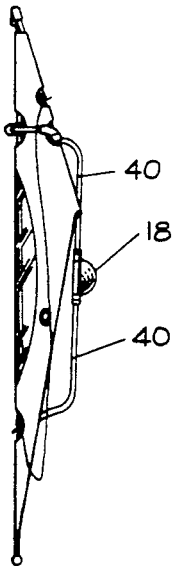
FIG. 4 is a side plan view of the invention.
Figure 5:
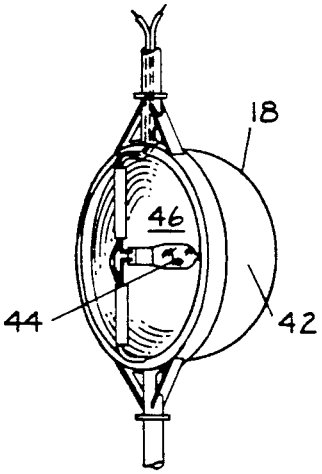
FIG. 5 is a partial perspective view of the illumination means of the invention.

As illustrated in FIGS. 1 and 2, body 14 is secured about frame means 12 by wrapping flaps 34 around the respective diagonal members and securing the same to the underside of body 14 utilizing adhesives or sewing techniques. Body 14 is similarly secured at point 36 to the lower end of longitudinal member 20.

Body means 14, in a specific embodiment is a sheet made of suitable material, which would include paper, plastic, tissue or the like. Body means 14 provides the sail which, in conjunction with aerodynamic forces, imparts lift to the kite.

As is readily apparent to one skilled in the art, conventional principles utilized in the kite industry can be incorporated into the present invention, and can be utilized in securing body means 14 to frame means 12.

The kite is also shown with string means 38 by which the kite is flown.

Interchangeable face means 16 allows for the selective substitution of various ornamental designs within the night kite. As illustrated in FIGS. 1 and 2, the interchangeable face means 16 is a transparent, circular envelope generally centrally positioned within body means 14. Interchangeable face means 16 will be further described hereinafter with reference to FIGS. 7, 8 and 9.

Referring now to FIGS. 3 through 6, illumination means 18 is shown as mounted upon bearing member 40. Bearing member 40 is mechanically connected at one end to longitudinal central member 20, and connected at the opposite end to third transverse member 30.

Illumination means 18 is illustrated as having a generally semi-spherical reflector 42 used in association with a light bulb 44. In a specific embodiment light bulb 44 is a high intensity light source utilizing a conventional DC power source such as batteries. Light bulb 44 is mounted in proximity to semi-spherical reflector 42, and protrudes within cavity 46 formed by the semi-spherical reflector 42.

The reflector and light bulb act in unison to create a highly efficient and controlled directional light source for maximizing the illumination of interchangeable face means 16. Illumination means is designed such that by incorporating the principles of a reflective housing, a light source powered by a DC battery, as well as the dimensional geometries of the interchangeable face means to be illuminated and the distance of the light means from the interchangeable face means, such that the invention achieves the greatest possible brightness for the ornamental designs placed within the envelope. By doing so, the invention allows the night kite to be perceptible to humans while being flown at great distances exceeding 200 feet in the air. The designs, colors, and contrasts of the ornamental designs are vividly portrayed and presented in a clear and striking manner to those people flying the kite and general observers.

In a specific embodiment, the semi-spherical reflector 42 is comprised of a plastic hull which has an interior reflective surface. The reflective surface is manufactured utilizing vacuum metalizing or electroplating techniques.

Figure 6:
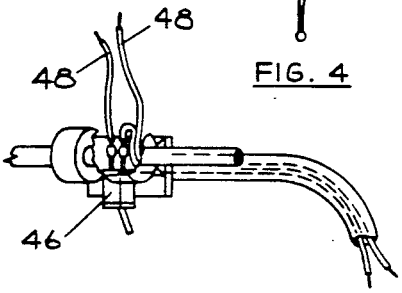
FIG. 6 is a partial perspective view of the switch means of the invention.

Referring now to FIG. 6, switch means 46 is illustrated. Switch means 46 applies power from a DC power source along conductors 48 to light bulb 44 in a conventional manner. As illustrated in FIG. 2, switch means 46 is interposed illumination means 18 and DC battery means 50.

Figure 7:
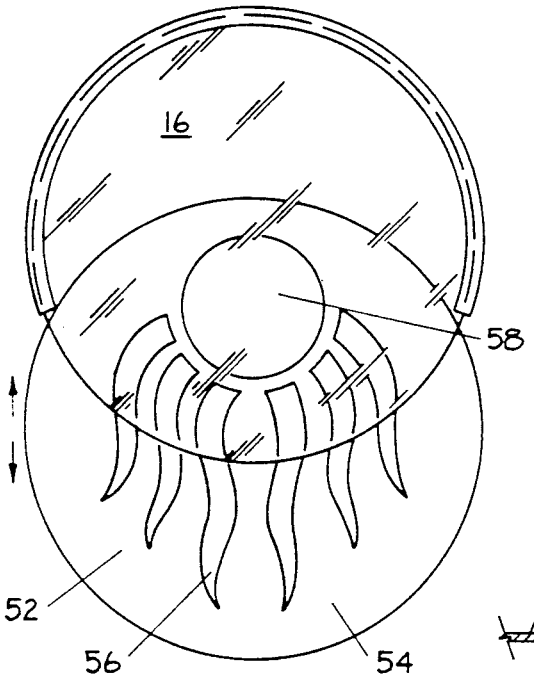
FIG. 7 is a front plan view of the invention illustrating placement of an ornamental design within an interchangeable face means.
Figure 8:
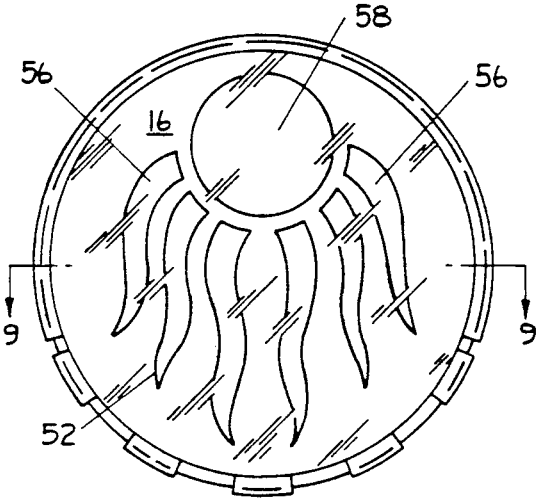
FIG. 8 is a front plan view of the invention illustrated in FIG. 7 subsequent to the placement of an ornamental design within the interchangeable face means.
Figure 9:
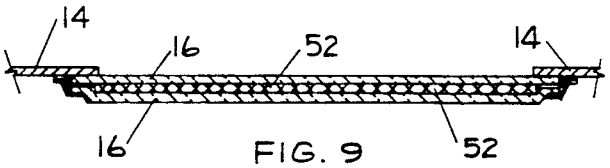
FIG. 9 is a cross sectional view of the invention taken substantially along lines 9—9 of FIG. 8.

Referring now to FIGS. 7, 8 and 9, interchangeable face means 16 is illustrated as a generally circular envelope made of a transparent material, into which an ornamental design 52 is placed. The transparent envelope 16 is secured in any conventional manner within kite body 14. The envelope could be secured utilizing adhesives, glues, tapes, or sewing techniques. The primary consideration is the placement of a transparent envelope in a centrally positioned location within body 14 such that upon activation of illumination means 18, light will flood the envelope.

As illustrated, ornamental design 52 is merely slid into envelope 16 in the direction of arrow 54.

FIG. 8 illustrates the invention wherein ornamental face means 52 is placed completely within transparent envelope 16.

It should be noted that the ornamental design can utilize various materials, any parcel or section of which can be either translucent, transparent, or opaque. Similarly, all known colors can be utilized which will allow the presentation of vividly contrasting color schemes to observers.

In a specific embodiment, ornamental design 52 is comprised of generally opaque material 54, translucent red flames 56, and translucent bright yellow sun 58. While flying this particular kite at night, observers will view at a great height a bright yellow burning sun and a plurality of red flames darting across the sky. As the kite is flown in darkness all remaining structure of the kite is undetected by the human eye. Thus, all that is apparent to observers is a flaming sun streaking by overhead. The invention utilizes a highly efficient light source with rich color schemes which results in striking visual effects.

As shown in FIG. 9, the ornamental design 52 is interposed opposite sides of envelope 16. Envelope 16 is likewise secured in a conventional fashion to body 14.

As is obvious, any of numerous designs, color schemes, and artistic renditions can be incorporated into the invention. This increases the scope of the invention in terms of functions and applications, and all are deemed to be within the inventive subject matter.

While there have been described above the principles of this invention in connection with specific apparatus, it is to be clearly understood that this description is made only by way of example, and not as a limitation to the scope of the invention.

I claim:

1. A kite designed for night flying, said kite having a facial ornamental design, comprising:

frame means for providing the structural support of said kite, said frame means including a plurality of frame members being in mechanical association with one another, body means for providing the aerodynamic flight characteristics of said kite, said body means being supported by said frame means;

said body means including an interchangeable face means;

said interchangeable face means for selectively substituting the ornamental design of said kite; and illumination means for illuminating said ornamental design of said kite, said illumination means being supported by said frame means, said illumination means rendering said kite readily visible at distances exceeding 100 feet while in night flight;

whereby a kite is provided which exhibits striking nocturnal features when viewed by the human eye.

2. The apparatus of claim 1, wherein said plurality of frame members includes a longitudinal central member, first and second diagonal members connected at one respective end to a common end of said longitudinal member, and first and second transverse members, each of said transverse members connected at one end to said longitudinal member, and generally perpendicular thereto, and connected at the opposite end to one of said diagonal members.

3. The apparatus of claim 2 further comprising a third transverse member connected at opposite ends to said diagonal members.

4. The apparatus of claim 1 wherein said body means comprises a sheet of suitable material secured about, and supported by, said frame means, said interchangeable face means generally centrally positioned within said body means, said interchangeable face means being a transparent receptive envelope within which said ornamental designs are selectively placed.

5. The apparatus of claim 4 wherein said ornamental designs are chosen from the group consisting of translucent, transparent, or opaque materials.

6. The apparatus of claim 3 wherein said illumination means comprises a high intensity battery operated light bulb placed in proximity to a highly luminous, generally semi-spherical reflector, said light and reflector being positioned behind said interchangeable means and illuminating said ornamental designs while said kite is engaged in night flight.

7. The apparatus of claim 6 wherein said light bulb is detachably mounted to said reflector, said bulb positioned within said reflector, said reflector being mounted to a bearing member, said bearing member mechanically connected at one end to said longitudinal member, and at the opposite end to said third transverse member.

8. A kite designed for night flying, said kite having interchangeable faces with varying ornamental designs, said kite having light means for illuminating the ornamental designs, comprising:

a frame for providing the structural support of said kite, said frame including a plurality of frame members being in mechanical association with one another, said plurality of frame members including a longitudinal central member, first and second diagonal members connected at one respective end to a common end of said longitudinal member, and first and second transverse members, each of said transverse members connected at one end to said longitudinal member, and generally perpendicular thereto, and connected at the opposite end to one of said diagonal members;

a body for providing aerodynamic flight characteristics of said kite, said body being supported by said frame, said body including a transparent, receptive envelope within which said ornamental designs are selectively placed, said receptive envelope generally centrally positioned within said body;

said light means comprising:

a high intensity battery-operated light bulb placed in proximity to a highly luminous, generally semi-spherical reflector, said light bulb and reflector being positioned behind said transparent, receptive envelope and illuminating said ornamental designs while said kite is engaged in night flight, said light rendering said kite readily visible;

said light bulb being detachably mounted to said reflector, said light bulb positioned within said reflector;

whereby a kite is provided which exhibits striking nocturnal features when viewed by the human eye.

* * * * *